United States Patent [19]

Banner

[11] 3,966,545

[45] June 29, 1976

[54] DEVICE FOR THE REMOVAL OF MACULATURE OR SIMILAR

[75] Inventor: Kurt A. Banner, Goteborg, Sweden

[73] Assignee: Mekantransport AB, Goteborg, Sweden

[22] Filed: Jan. 28, 1975

[21] Appl. No.: 544,787

[30] Foreign Application Priority Data

Jan. 28, 1974 Sweden ..... 7401034

[52] U.S. Cl. ..... 162/264; 34/85; 198/218

[51] Int. Cl.[2] ..... D21F 1/66

[58] Field of Search ..... 198/139, 218, 229; 214/83.34; 242/67.4; 162/191, 264; 34/85

[56] References Cited

UNITED STATES PATENTS

| | | | |
|---|---|---|---|
| 819,542 | 5/1906 | Hague | 198/218 |
| 2,436,657 | 2/1948 | McCulloch | 198/139 |
| 2,509,097 | 5/1950 | Hinz | 198/218 |
| 2,516,798 | 7/1950 | Peterson | 198/218 |
| 2,563,158 | 8/1951 | Claffey | 214/83.34 |
| 2,822,913 | 2/1958 | Craggs et al. | 198/139 |
| 2,954,082 | 10/1960 | Moore | 162/191 X |
| 3,184,374 | 5/1965 | Pearson | 198/218 X |
| 3,236,723 | 2/1966 | Whiteside | 162/264 |
| 3,251,455 | 5/1966 | Lorvi | 198/139 |
| 3,333,574 | 8/1967 | Harris | 198/218 X |
| 3,645,517 | 2/1972 | Mennen | 34/85 X |
| 3,680,805 | 8/1972 | Stewart et al. | 242/67.4 |
| 3,795,304 | 3/1974 | Poundstone | 198/139 |

*Primary Examiner*—Evon C. Blunk
*Assistant Examiner*—Richard K. Thomson

[57] ABSTRACT

A device in a paper manufacturing machine is described for removal of maculature collecting underneath the paper web on rupture of the paper comprising a cloth alternatively stretched beneath the machine and removable at one end thereof by a wind up roller to remove and discharge the maculature from the machine and stretchable beneath the machine by wires connected to the other end of the cloth and to driving means.

5 Claims, 4 Drawing Figures

DEVICE FOR THE REMOVAL OF MACULATURE OR SIMILAR

In the drier section of paper machines a great lot of so called maculature is piling up in the lower portion of the machine in connection with interruptions in the operation, by way of example in case of breakage of the paper web. These paper quantities must be removed by hand, which work in the prior art has been carried out by attending workmen, which in this connection have to be present under the paper web inside the hood, which generally surrounds the drier section. Inside said hood the temperature as well as the sound level is very high, which causes considerable inconveniences to the workmen and also involves certain risks, when the machine is running.

It is an object of the present invention to eliminate said inconveniences by means of a device for the removal of maculature or similar piling up under the paper machine, which device can be moved aside in order to make possible the presence of repair personnel or similar in the space underneath the paper web by way of example for the purpose of exchanging the rollers.

Said object is reached by the device according to the present invention, which substantially is characterized by a cloth or similar, which is stretchable below the paper web in order to receive the maculature, by a driven driving roller connected with one end of the cloth, on which roller the cloth can be wound up for the purpose of removing the maculature, and by a pulling device connected with the other end of the cloth, by means of which device the cloth can be unwound from the roller for the purpose of said stretching.

Figure 1:
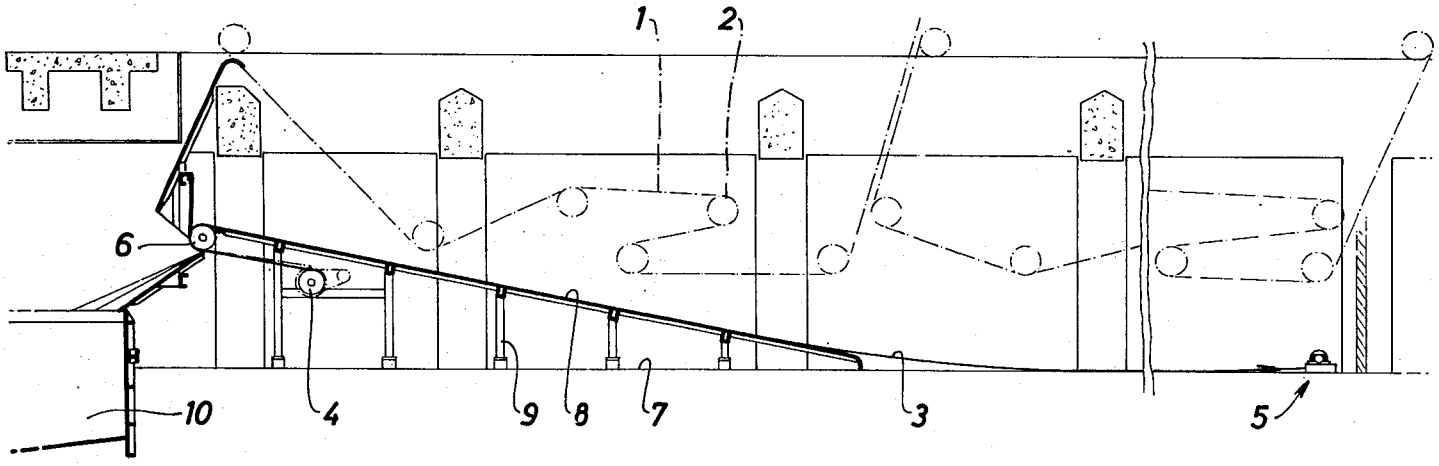
Figure 2:
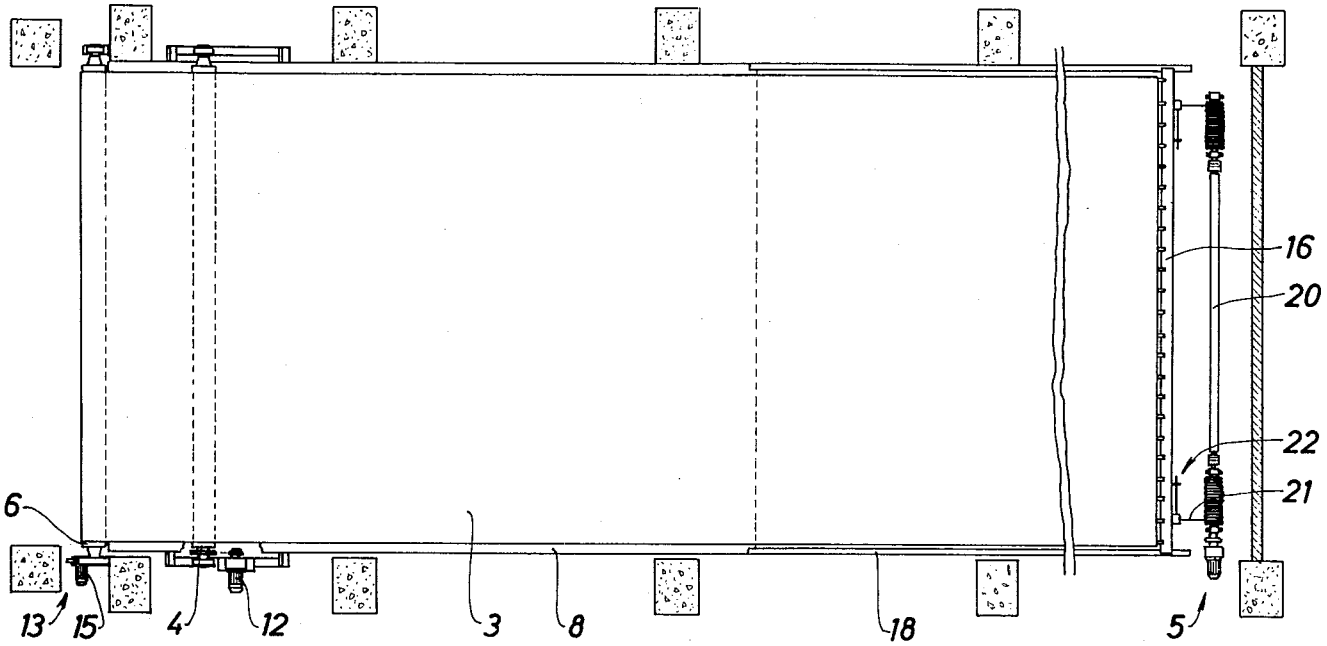
Figure 3:
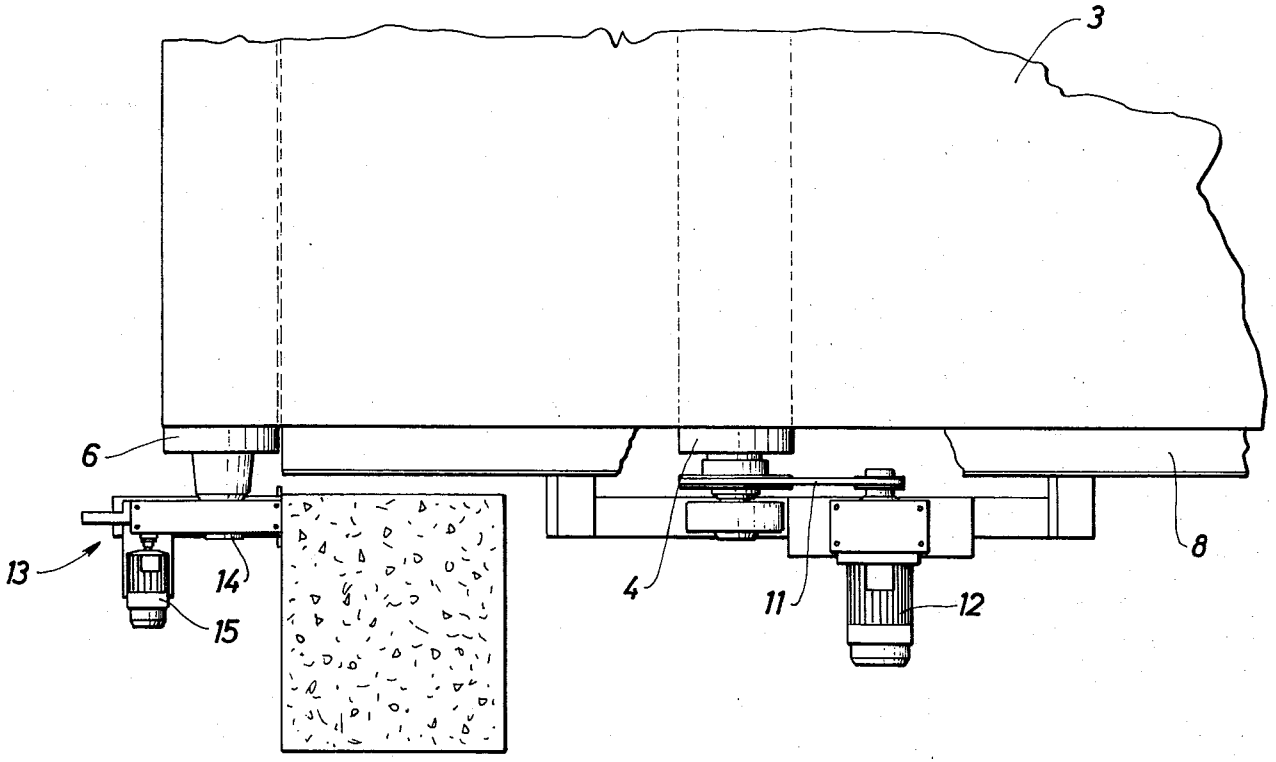
Figure 4:
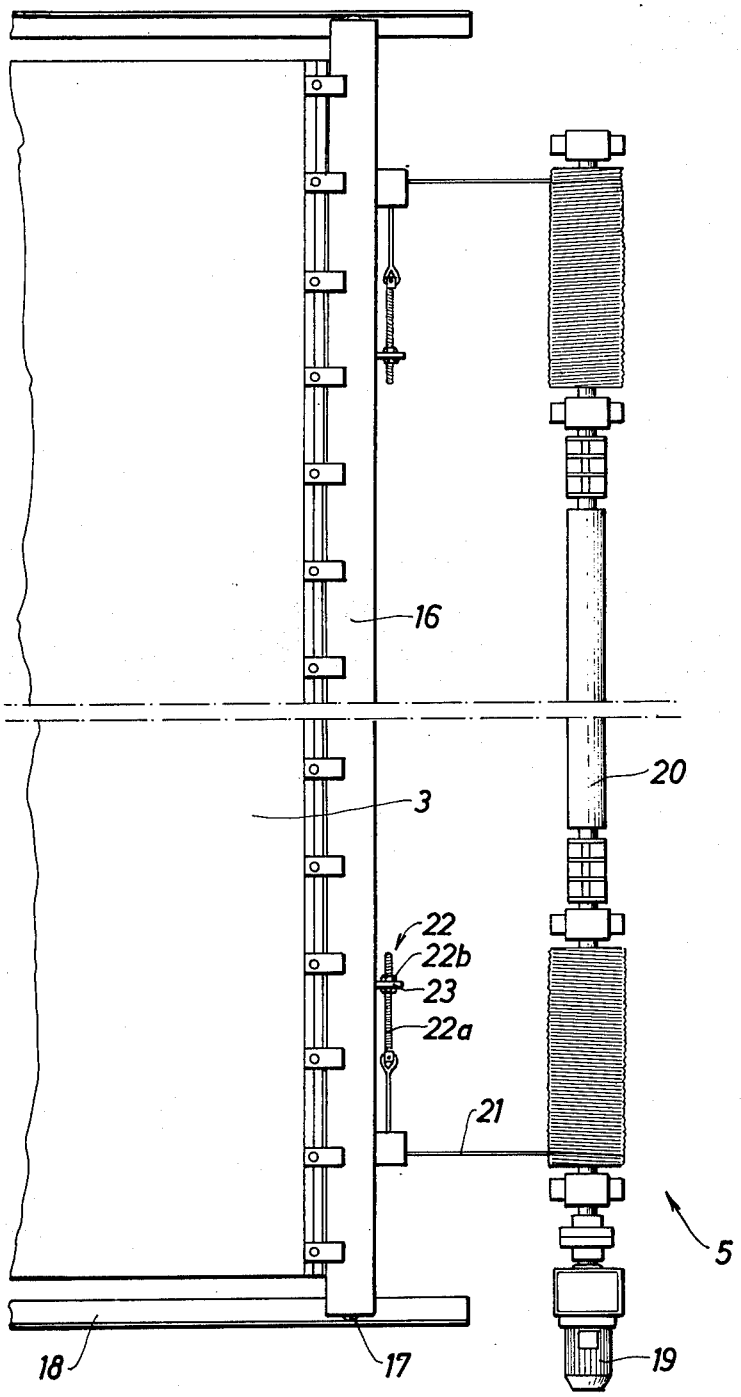

An example of an embodiment of the invention will now be described more in detail with reference to the accompanying drawings, in which FIG. 1 is a schematic side elevational view of the device according to the invention, FIG. 2 is a plan view of the same, FIG. 3 is a partial view of a driving roller and a pulley roller forming part of the device, and FIG. 4 is a partial view of a pulling device forming part of the device according to the invention.

In FIG. 1 the device according to the invention is shown in a location at the drier portion of a paper machine in a space underneath the paper web running through the drier portion. In order to obtain a maximum length of travelling distance in the drier portion and consequently a maximum drying effect, the paper web travels in labyrinths carried by a number of endless wires 1 located in the drier portion and forming endless conveyors, which are driven by a great number of drier rollers 2 (indicated at a dashed and dotted line). The device according to the invention as is evident from FIG. 1 as well as from FIG. 2 substantially comprises a cloth 3, which in the position illustrated extends along substantially the whole length of the drier section and occupies the whole width of the paper web, a driving roller 4 located at the front end of the drier section, one end of the cloth being connected with said driving roller on which the cloth can be wound up, and by a pulling device 5 located at the rear end of the drier section, which device is connected with the other end of the cloth. Moreover a pulley roller 6 located at the receiving end of the drier section forms parts of the assembly, the cloth travelling over this roller before it is wound up on the driving roller 4. A supporting plate 8 extends from the floor 7 under the machine at an oblique angle towards the pulley roller 6, said plate being supported by a number of legs 9. A tray 10 is located below the pulley roller 6 and serves the purpose of collecting maculature for dissolution, beating or similar.

As is most clearly evident from FIG. 3 the driving roller 4 via a power transmission, in the example of embodiment illustrated being a belt drive 11 is connected with an electric motor 12 for driving the roller 4 for winding up of the cloth 3. The pulley roller 6 at one end is provided with adjustable means 13, by means of which the end of the pulley roller can be displaced along a chosen very small distance, whereby certain possible lateral displacements of the cloth 3 during its winding up on the driving roller 4 can be compensated. In the example of embodiment shown, such adjustment is carried out by displacing by means of an electric motor 15 via a power transmission a bearing box 14 supporting said end of the pulley roller 6.

In FIG. 4 the pulling device 5 located in the receiving portion of the drier section is shown, which device tends to keep the cloth 3 stretched and further brings about the unwinding of the cloth from the driving roller 4. The pulling device 5 is attached to the other end of the cloth via a bar 16 extending crosswise over the width of the cloth. Said bar at its ends is provided with guiding wheels 17, which are arranged to travel in guiding rails 18 by way of example having the shape of an L-iron and extending along both sides of the drier section to the supporting plate 8. The pulling device 5 is provided with an electric motor 19, which is arranged to drive a shaft 20 extending at right angle to the longitudinal extension of the cloth 3, on which shaft two wires 21 are wound up, one end of each wire being attached to the shaft and the other end being adjustably attached to the bar 16 by means of an adjusting means 22, which in the example of embodiment illustrated comprises a threaded bar 22*a* connected with the wire and led through a hole in a portion 23 projecting from the bar and locked to said portion 23 by means of nuts 22*b*.

When by way of example the paper web running through the drier section suffers a rupture, a great quantity of paper will continue its forward feed, before the paper web as a routine measure in case of breakage is cut off by means of a knife placed at a suitable location and the machine can be stopped. Maculature is collected on the cloth 3 forming part of the device according to the invention, which cloth during the normal operation of the paper machine is stretched in the space underneath the endless wire 1, as is shown in FIGS. 1 and 2. When a suitable opportunity is afforded, the electric motor 12 is started, whereby the driving roller 4 is brought in rotation winding up the cloth 3 travelling around the pulley roller 6. In connection with the movement of the cloth along the floor 7 of the machine and up the supporting plate 8, the quantities of paper on the cloth are brought along, and on their arrival at the pulley roller 6 they fall down from said roller, when the cloth passes over the same, landing on the tray 10 for subsequent treatment for example in order to be reconverted to pulp again. In order to provide a good control of the dislacement of the cloth 3 and its winding up on the driving roller 4 the pulling device 5 exercises a pulling force opposed to the pulling force acting upon the cloth in the winding up direction, said opposed pulling force however, being considerably less than the winding up force. This opposed pulling force is obtained by means of a braking torque being applied to the shaft 20, which operation is carried out by a voltage, which is lower than the intended for normal operation, being applied to the electric motor 19, which in such am assembly suitably is a rotating field motor. The stretch and stable movement of the cloth 3 is also secured by means of the inherent weight of the bar 16 and moreover by the guiding action of the guide wheels in the guiding rails 18.

When all maculature collected on the cloth 3 has been removed and thus passed over the pulley roller 6 and fallen down into the tray 10, the cloth is stopped by interruption of the voltage of the driving motor 12 of the driving roller 4, whereafter the cloth suitably is immediately returned to the starting position shown in FIG. 1. In this connection full operation voltage is applied to the driving motor 19 of the pulling device 5, whereby the shaft 20 is rotated for winding up of the wires 21, which brings in its train the unwinding of the cloth from the driving roller 4. When the cloth 3 with its crosswise extending bar 16 substantially has arrived at the pulling device 5, said device is stopped by the voltage of the driving motor 19 being interrupted, whereby the cloth again is stretched in its total extension in the space underneath the paper web in the drier section, and is again ready to receive paper quantities collecting themselves in connection with a subsequent interruption of the operation.

As the removal of the maculature can be undertaken at a time, which is convenient for the workmen, it is in many cases sufficient with a manual control of the device for removal according to the invention, for example using a manual push botton switch. However, it is of course conceivable to automate this control entirely or in part by means of for example known devices.

The invention is not limited to the example of embodiment described above and illustrated in the drawings, but can be varied within the scope of the following claims. By way of example it is conceivable to apply a braking torque in connection with the unwinding of the cloth 3 from the driving roller 4 — in the present case to the driving roller — by way of example in a manner corresponding the way of winding up the cloth on the driving roller in connection with the pulling device 5. Moreover, it is in principle conceivable to dispense with the pulley roller 6 and as a substitute use the driving roller 4, which in such a case is given an opposite unwinding direction as compared with the example shown.

Finally it should be noted that the cloth 3 entering into the assembly of the device to advantage can be comprised by a discarded endless wire cloth of the machine, as such a cloth has very suitable properties for this purpose for example because of its dimensions, making it possible to manufacture the device according to the invention at a very reasonable cost.

I claim:

1. In a paper manufacturing machine, a device for the reception and removal of maculature collecting underneath the paper web in said machine comprising a cloth, stretchable in the space underneath the machine, a winding roller, driven by driving means and connected with one end of said cloth and arranged to wind up the cloth for the purpose of removing the cloth with the maculature collected thereon from said space leaving the same free, a discharge station for the discharge of the maculature over a linked portion of the cloth when being wound up, and a pulling device connected with the opposite end of said cloth by means of two wires and arranged to unwind the cloth from the winding roller and stretch the cloth in said space underneath the paper machine, said pulling device comprising a shaft which is rotatable by driving means in order to wind up said wires.

2. A machine according to claim 1, wherein said discharge station comprises a tray arranged underneath a pulley roller in order to collect discharged maculature for the purpose of further treatment.

3. A machine according to claim 1, further comprising a bar placed at said opposite end of said cloth and extending over the width of the cloth, which bar by means of controlling means positioned at its ends is arranged to travel in two guiding rails extending along the longitudinal borders of the cloth.

4. A machine according to claim 1 wherein said discharge station includes a pulley roller forming said linked portion of the cloth for the purpose of discharging the maculature.

5. A machine according to claim 4, further comprising a supporting plate wich at an oblique angle relative to the horizontal plane extends in a direction toward the pulley roller and on which plate the cloth is adapted to slide.

* * * * *